US005664748A

United States Patent [19]

Speece et al.

[11] Patent Number: 5,664,748

[45] Date of Patent: Sep. 9, 1997

[54] UNIVERSAL MAIL BOX MOUNTING BASE

[75] Inventors: Stephen Speece, Youngstown; Charles Richard Nestor, Niles, both of Ohio

[73] Assignee: Steel City Corporation, Youngstown, Ohio

[21] Appl. No.: 548,644

[22] Filed: Oct. 26, 1995

[51] Int. Cl.[6] ..... A47B 96/06

[52] U.S. Cl. ..... 248/219.2; 248/220.21; 232/38; 232/39

[58] Field of Search ..... 248/219.2, 207, 248/220.21, 146, 152, 158, 154; 232/17, 38, 39

[56] References Cited

U.S. PATENT DOCUMENTS

| | | | |
|---|---|---|---|
| 2,552,915 | 5/1951 | Zachrich | 248/221 |
| 3,556,393 | 1/1971 | Fibus | 232/17 |
| 4,120,446 | 10/1978 | Fuemmeler | 232/17 |
| 4,893,747 | 1/1990 | Roth | 232/39 |
| 5,169,062 | 12/1992 | Baker | 232/1 C |
| 5,337,954 | 8/1994 | Kobilarcik et al. | 232/38 |

*Primary Examiner*—Leslie A. Braun
*Assistant Examiner*—Gwendolyn W. Baxter
*Attorney, Agent, or Firm*—Harpman & Harpman

[57] ABSTRACT

A mail box mounting bracket for securing multiple size mail boxes to a variety of post mounting configurations. The mounting bracket has a plurality of removable elements that are used to adapt the bracket to different size mail boxes. The mounting bracket has depending post engagement flanges and multiple apertured mounting lugs for alternate mounting configurations to different post engagement alignments required.

8 Claims, 5 Drawing Sheets

UNIVERSAL MAIL BOX MOUNTING BASE

BACKGROUND OF THE INVENTION

1. Technical Field

This device relates to brackets used to mount mail boxes to a support element. Mail boxes vary in size and are mounted to support posts and arms in different support box engagement alignments in both vertical and horizontal situations.

Due to this inherent problem of mounting new mail boxes to existing posts and arms the user typically is required to select a mail box that will fit the existing post situation which limits the style and more importantly the size of the new mail box. The same problem exist with new support posts which are typically of a common dimension with or without mounting arms so that the user must fabricate box mounting adapters which usually are less than secure support connections between the box and the post.

2. Description of Prior Art

Prior art devices rely on a variety of different bracket configurations to mount mail box like receptacles to support posts and the like, see for example U.S. Pat. Nos. 2,552,915, 4,120,446, 5,169,062 and 5,337,954.

In U.S. Pat. No. 2,552,915 a rural mail box supporting bracket is disclosed having adjustable two-part base structure that provides for longitudinal adjustment along the longitudinal axis of the box with a fixed transverse box engagement bracket.

U.S. Pat. No. 4,120,446 is directed towards a newspaper delivery tube mounting bracket that discloses an L-shaped bracket that mounts newspaper route tubes to a vertical support post.

Referring now to U.S. Pat. No. 5,169,062 a newspaper delivery tube is illustrated having a mounting area that is adaptable to post mounting brackets with integral engagement areas therebetween.

Finally, in U.S. Pat. No. 5,337,954 a mail box mounting bracket is disclosed that engages and secures to a matching mail box a vertical support post. The mounting bracket is keyed to receive and frictionally engage a matching mounting configuration on the mail box.

SUMMARY OF THE INVENTION

An adjustable mail box mounting bracket having selectively removable portions that are used to adapt the mounting bracket to a variety of different size mail boxes. The mounting bracket has multiple support parts and arm engagement areas to provide for mounting different size mail boxes in different post alignment engagement configurations all from a single molded bracket entity.

DESCRIPTION OF THE PREFERRED EMBODIMENT

Figure 1:
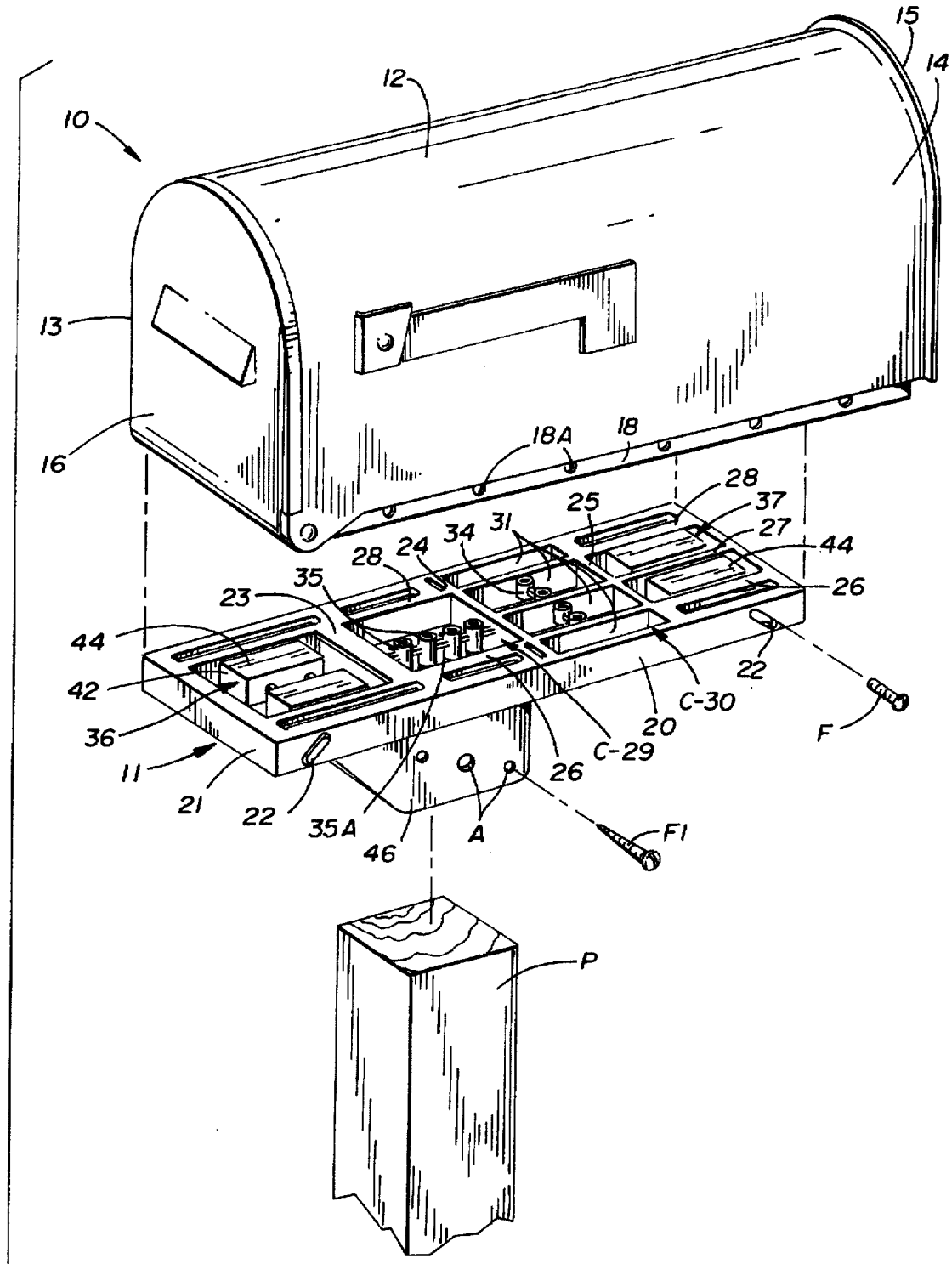
FIG. 1 is an exploded perspective view of a mail box and mounting bracket of the invention for securing the mail box to a support post.

A mail box 10 and a mounting bracket 11 can be seen in FIG. 1 of the drawings, the mail box 10 is of a typical construction having a curved top portion 12, oppositely disposed integral sidewalls 13 and 14, a fixed end 15 and a pivoted door 16. The sidewalls 13 and 14 defining extending mounting flanges 18 and 19 with a recessed bottom 17 inwardly thereof.

The flanges 18 and 19 are typically apertured at 18A in spaced longitudinal alignment thereon for mounting purposes as will be apparent to those skilled in the art.

The mounting bracket 11 of the invention is formed of a molded synthetic resin material in a one-piece integral structure having laterally spaced sidewalls 20 and opposing interconnected end walls 21. The sidewalls 20 have spaced elongated mounting apertures 22 in cross alignment with one another to receive fasteners F therethrough.

A plurality of transversely extending rib members 23, 24, and 25 and interconnecting longitudinally extending rib members 26, 27 and 28 form a number of compartments therebetween generally referred to as C. Some of the compartments C specifically C-29 and C-30 have partially enclosed bottoms at 29A and B and 30A and B best seen in FIG. 2 of the drawings. The compartment bottoms 29A and B are in spaced opposing enclosed area each having a pair of apertured lugs 31 extending therefrom. The compartment bottoms 30A and B are also on enclosed areas, each having multiple apertured lugs 32 extending therefrom and extending transversely and between the respective sidewalls 20 spanning a plurality of small compartments with the main compartments C-30 formed by the spaced parallel longitudinally extending rib elements 26, 27 and 28 as hereinbefore described.

A plurality of interconnected longitudinally spaced tubular spacers 34 extend between said respective rib members 26 and 27 and 27 and 28 and are arranged so as to be removable therefrom. A second set of interconnected longitudinally spaced tubular spacers 35 extend between the rib members 23 and 24 as will be described in greater detail hereinafter.

Figure 2:
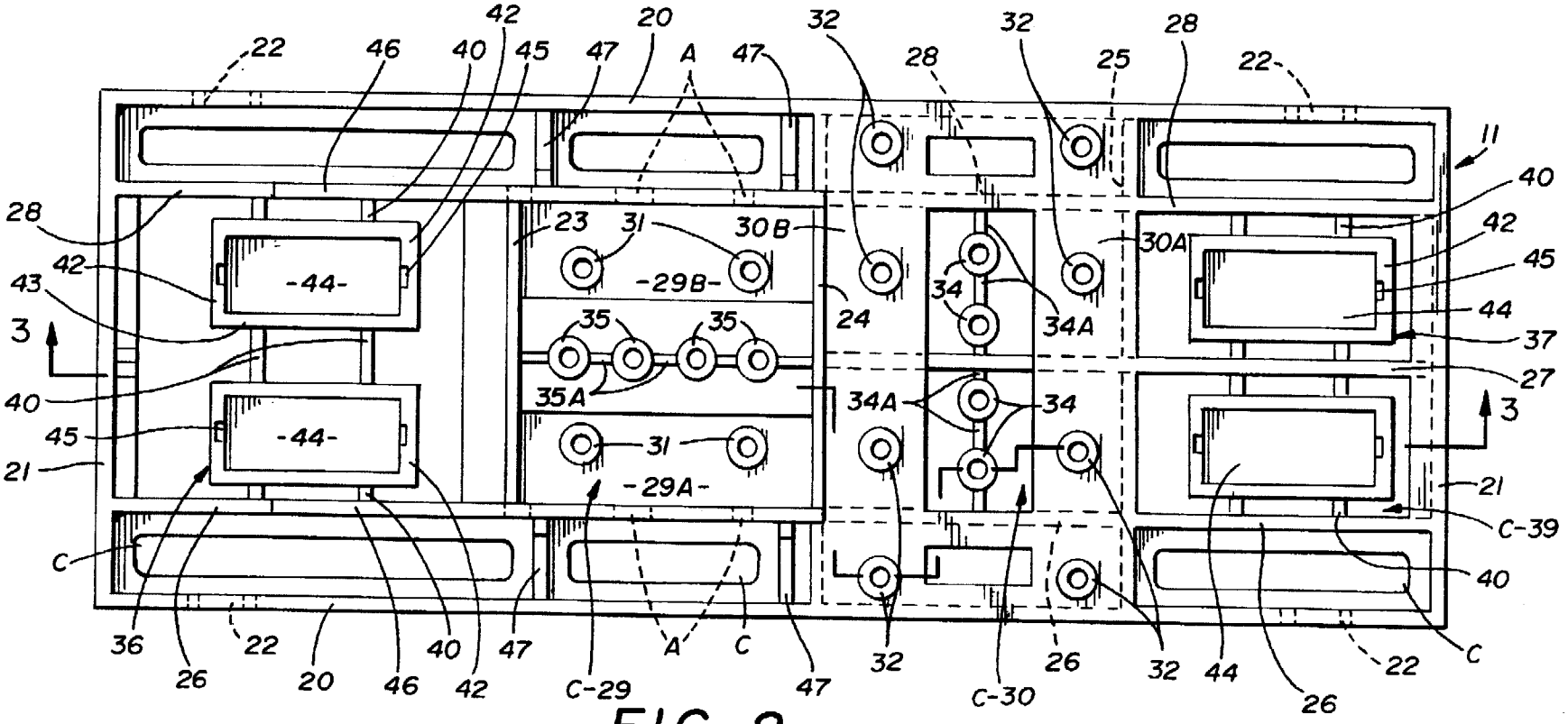
FIG. 2 is a bottom plan view of the mounting bracket shown in FIG. 1.
Figure 3:
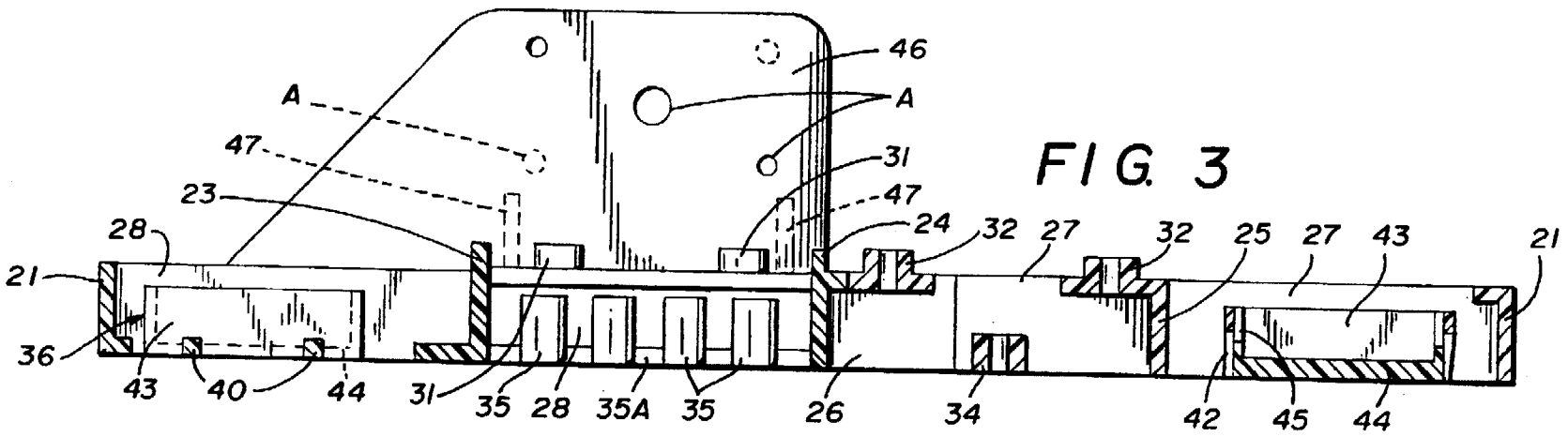
FIG. 3 is a cross-sectional view on lines 3—3 of FIG. 2.

Referring now to FIGS. 1, 2, and 3 of the drawings, pairs of spacing blocks 36 and 37 are removably positioned in the remaining compartments C-38 and C-39 from between the end walls 21 and the rib member 23 and between rib member 25 and end wall 21 and respective cross rib members 26 and 27 and 27 and 28. Each spacer block within said block pairs 36 is interconnected to its adjacent block and adjacent rib walls by removable connecting elements 40 and correspondingly in block pair 37 to adjacent rib members by removable connecting elements 41 best seen in FIG. 2 of the drawings. Each of said block spacers has apertured ends 42, interconnected sides 43 and an integral top 44.

Figure 10:
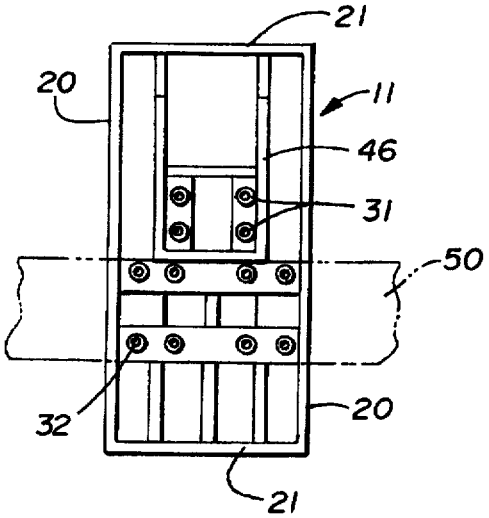
FIG. 10 is a bottom view of the mounting bracket indicating a transverse mounting configuration on a support element shown in broken lines.
Figure 11:
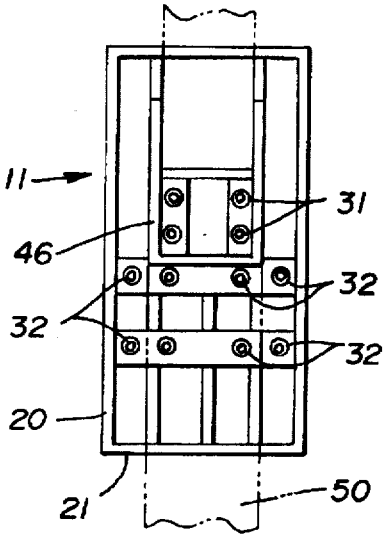
FIG. 11 is a bottom view of the mounting bracket including a longitudinal mounting configuration on a support element shown in broken lines.

The apertured ends 42 have recessed areas at 45 aligned with said apertures therein for receiving a fastener. Additional compartment areas are formed between the hereinbefore described ribs and wall elements and serve no other specific purpose other than to save plastic material to reduce manufacturing cost of the mounting bracket. The rib and wall configuration so described do provide, however, the required strength for the bracket and help define alternate post mounting positions as illustrated in FIGS. 9, 10, and 11 of the drawings which will be discussed in greater detail hereinafter.

Figure 4:
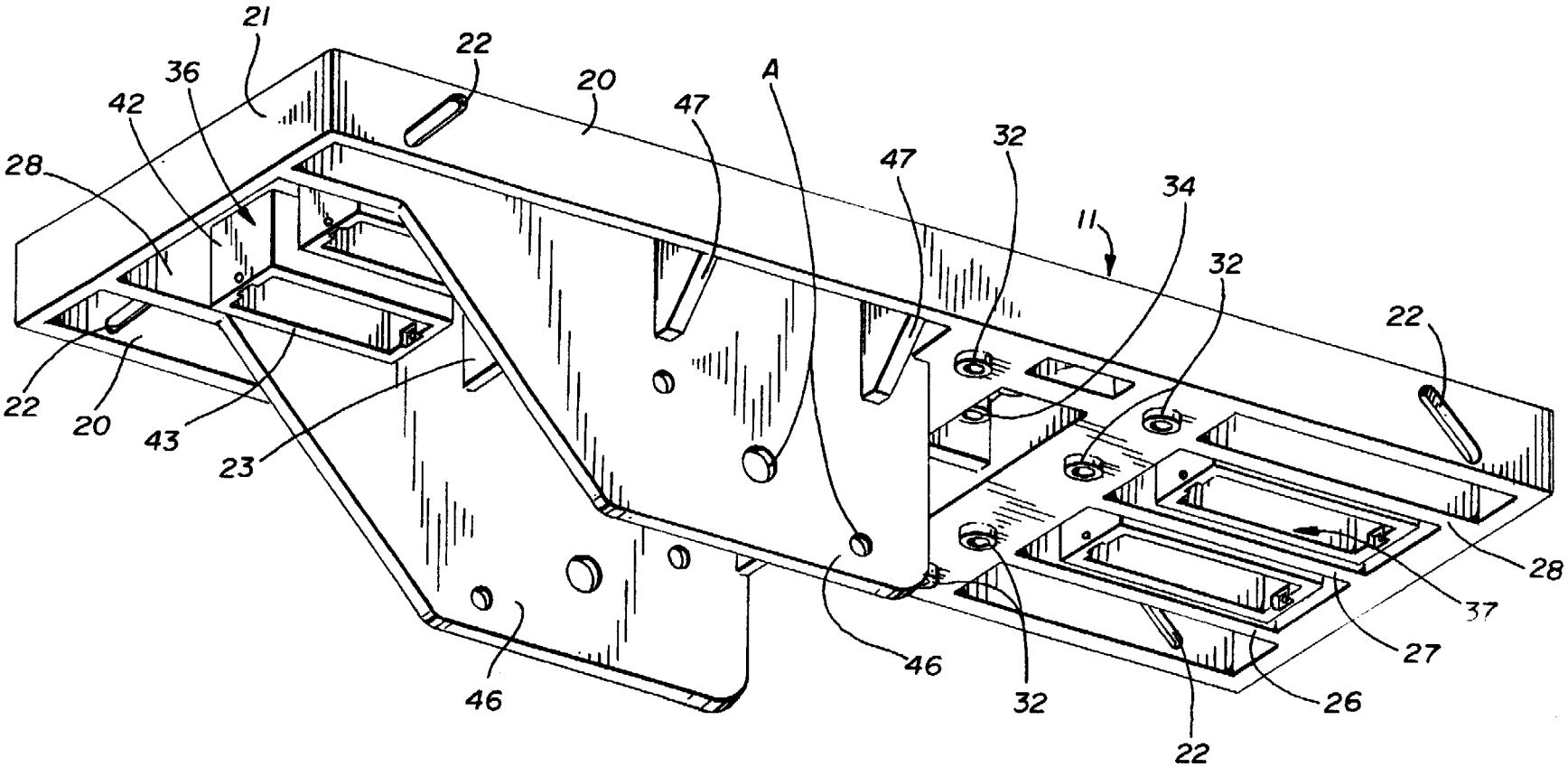
FIG. 4 is a perspective bottom and side view of the mounting bracket of the invention.
Figure 9:
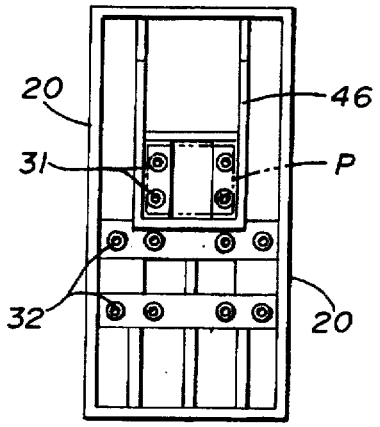
FIG. 9 is a bottom view of the mounting bracket indicating a vertical post engagement mount.

Referring back to FIGS. 1, 2 and 3 of the drawings, mounting flanges 46 depend from the bottom portion of the respective ribs 26 and 28 of the mounting bracket to assist in vertical mounting on a post P as illustrated in FIGS. 1 & 9, each of the mounting flanges has a pair of tapered support webs 47 extending therefrom, best seen in FIG. 4 of the drawings. The depending mounting flanges 46 are apertured at A-1 to accept fasteners F-1 as will be well known to those skilled in the art.

Figure 7:
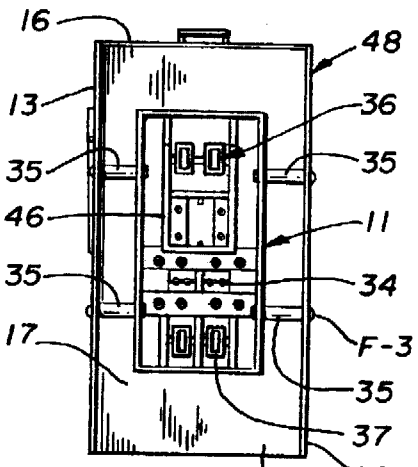
FIG. 7 is a bottom view of the mounting bracket secured to a larger mail box using removable adaptive spacer elements from the mounting bracket.
Figure 6:
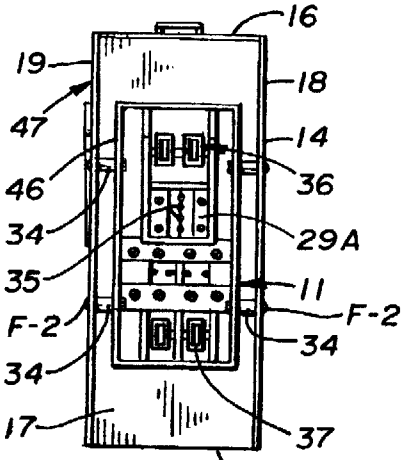
FIG. 6 is a bottom view of the mounting bracket secured to a larger mail box using removable adaptive spacer elements from the mounting bracket.
Figure 5:
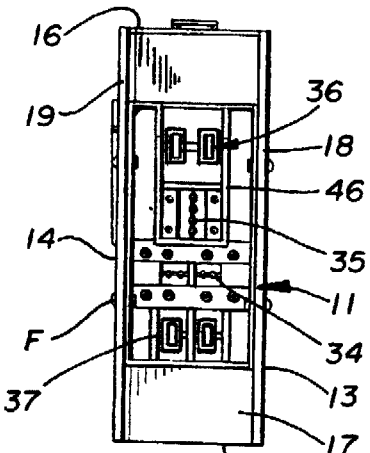
FIG. 5 is a bottom view of the mounting bracket of the invention secured to a standard size mail box.

Referring to FIGS. 2 and 3 of the drawings, the tubular spacers 34 and 35 can be selectively removed from the mounting bracket by detaching interconnecting elements 34A and 35A and used to mount different size mail boxes 47 and 48 respectively by alignment to elongated mounting apertures 22 and respective apertured mail box mounting flanges as will be seen in FIGS. 5, 6, and 7 by utilizing a plurality of fasteners F2 and F3 respectively.

Figure 8:
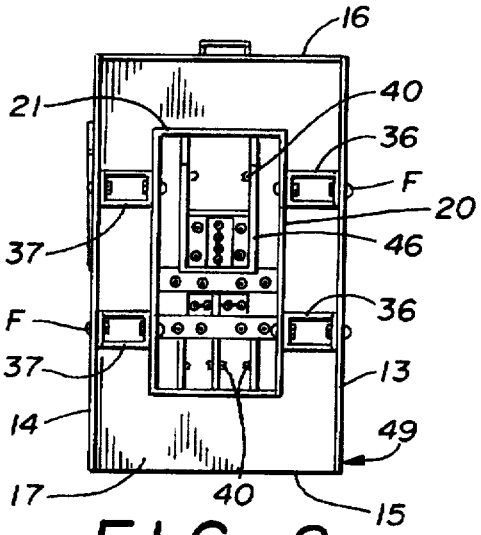
FIG. 8 is a bottom view of the mounting bracket secured to a larger mail box using removable adaptive box shaped spacer elements.
Figure 12:
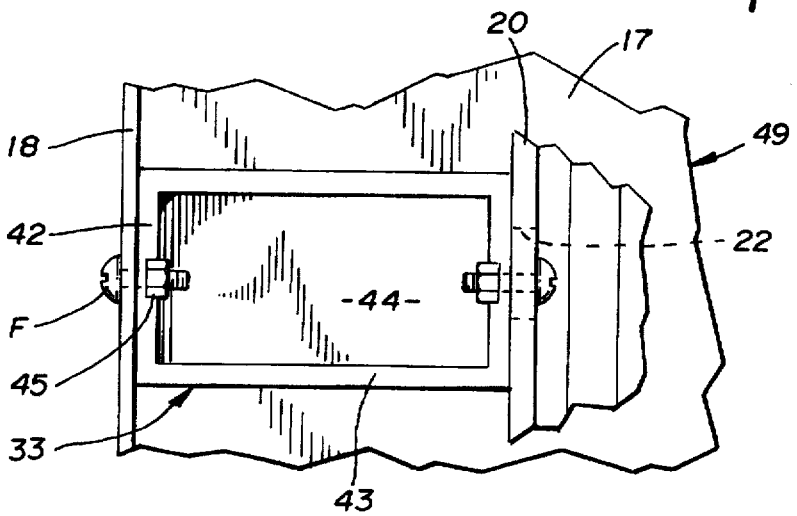
FIG. 12 is an enlarged view of the box spacers engaged between a mail box illustrated in FIG. 8 and the mounting bracket.

Referring to FIGS. 2, 8 and 12 of the drawings, the mounting bracket 11 of the invention can be utilized to be secure to the bottom 17 of an oversize mail box 49 by using removable pair of spacer blocks 36 and 37 and pairs of fasteners F through said respective apertured ends 42, and recesses 45 best seen in FIG. 12 of the drawings as hereinbefore described.

Now referring to FIGS. 9–11 of the drawings a post (P) and arms 50 multiple mounting configurations are illustrated wherein the mounting bracket 11 of the instant invention can be secured to a vertical post P, FIGS. 9 and 1, utilizing hereinbefore disclosed flanges 46 and the apertured lugs 31. In FIG. 10 of the drawings, mounting to an arm 50 shown in broken lines extending thereacross is illustrated utilizing apertured lugs 32 or longitudinally on the arm 50 shown in broken lines in FIG. 11 using a combination of lugs 31 and 32 on which the arm 50 overlies.

The mail box mounting bracket 11 of the instant invention will thus accommodate a variety of different size mail boxes that have mounting spacing flanges by use of selective groups of the hereinbefore described tubular spacers 34 and 35 and block spacers 36 and 37 all of which are removably secured to the mounting bracket 11 initially and can be used as required. The multiplicity of apertured lugs 31 and 32 extending from the bottom of the mounting bracket as hereinbefore described allow for different mounting requirements on posts and support arm configurations.

It will thus be apparent to those skilled in the art that various changes and modifications may be made therein without departing from the spirit of the invention, therefore.

We claim:

1. A mounting bracket for mail boxes, said mounting bracket comprises oppositely disposed sidewalls, opposed end walls, a top surface and a bottom surface, a plurality of interconnected rib walls extending between said respective end walls and sidewalls, compartments formed between said rib walls, a plurality of spacing elements removably secured within said compartments, said spacing elements having interconnecting means to one another and said adjacent rib walls within their respective compartments, some of said spacing elements are-of a known length less than that of said remaining spacing elements, flanges extending inwardly from said rib walls in spaced relation to one another defining said bottom surface, lug means on said flanges, some of said spacing elements define blocks having sidewalls, apertured end walls and integral top, means depending from said rib wall's bottom surface for securing the bracket to post means.

2. The mounting bracket for mail boxes of claim 1 wherein said means depending from said rib walls for securing said mounting brackets to the post means comprises spaced apertured mounting flanges.

3. The mounting bracket for a mail box of claim 2 which further includes gussets between said mounting flanges and said mounting bracket.

4. The mounting bracket for mail boxes of claim 2 wherein said mounting flanges extend from said rib walls are integral therewith.

5. The mounting bracket for mail boxes of claim 1 wherein said sidewalls have pairs of longitudinally spaced elongated apertures therein aligned for registration with portions of said mail box.

6. The mail box mounting bracket of claim 1 wherein said lug means comprise a plurality of spaced aligned apertured lug elements extending from said bottom surfaces.

7. The mounting bracket for a mail box as set forth in claim 1 wherein said means for interconnecting said spacing elements to one another and said adjacent rib wall comprises frangible connection elements extending therebetween.

8. The mounting bracket for a mail box as set forth in claim 1 wherein some spacing elements are cylindrical.

* * * * *